United States Patent [19]

Redeker

[11] Patent Number: 4,996,000

[45] Date of Patent: Feb. 26, 1991

[54] MULTILAYER CLEANSING BAR

[76] Inventor: Dale R. Redeker, 2914 Doncrest, Kalamazoo, Mich. 49007

[21] Appl. No.: 306,331

[22] Filed: Feb. 3, 1989

[51] Int. Cl.[5] ..... C11D 9/20; C11D 17/00

[52] U.S. Cl. ..... 252/92; 252/90; 252/134; 252/DIG. 16; 252/131

[58] Field of Search ..... 252/90, 92, 134, 174, 252/DIG. 16, 174.25, 131

[56] References Cited

U.S. PATENT DOCUMENTS

| | | | |
|---|---|---|---|
| 102,546 | 5/1870 | Hull | 252/90 |
| 692,481 | 2/1902 | Robinson | 252/90 |
| 1,083,571 | 1/1914 | Waltke | 252/90 |
| 1,328,898 | 1/1920 | Ricketts | 252/93 |
| 3,408,299 | 10/1968 | Henry | 252/134 |

FOREIGN PATENT DOCUMENTS

| | | |
|---|---|---|
| 842879 | 6/1939 | France . |
| 977194 | 3/1951 | France . |
| 492 | of 1867 | United Kingdom . |
| 2831 | of 1902 | United Kingdom . |
| 683 | of 1904 | United Kingdom . |
| 663213 | 12/1951 | United Kingdom . |

*Primary Examiner*—Prince E. Willis

*Attorney, Agent, or Firm*—Charles J. Prescott; Raymond H. Quist

[57] ABSTRACT

A cleansing bar having a plurality of layers of different cleansing materials. The structure permits selectively using one of the materials at a time. One layer may have an undulating surface and this surface may have different cleansing materials on opposite faces. The bar may be longitudinally divided in half with the two halves being relatively rotatable.

4 Claims, 1 Drawing Sheet

2
12
14
2
10

12
14

4
22
20
22
20
22
20
16
18
4

20
18

24

22
20
18
30
26
8
28
28
26
8
30

32
36
36
34
30
28

MULTILAYER CLEANSING BAR

BACKGROUND OF THE INVENTION

1. Field of the Invention

This invention relates generally to cleansing bars, and more particularly to cleansing bars having a plurality of layers of different cleansing materials.

2. Description of Related Art

Solid cleansing materials in the form of bars or cakes have been commercially available for many years. These bars may be soap or detergents, and may contain various other substances such as coloring materials, perfumes, and fillers. Scouring bars may contain soap with large percentages of abrasive materials such as diatomaceous earth, clay, finely powdered silica, or volcanic ash. Although many of the different cleansing bars are basically the same, there are some differences which are caused by different cleansing needs. For example, skin on some parts of the body may be more sensitive then other areas. Some body areas are also more prone to perspire than other areas. In addition, the hands often are exposed to more hard to remove dirt and grease than the rest of the body. These divergent cleansing problems have led to the production of different cleansing bars designed for the different needs. Moreover, various individuals in a household may have different preferences or needs, so that a household may keep on hand at the lavatory or the shower several different cleansing bars.

It is therefore an object of this invention to provide a cleansing bar which will incorporate more than one cleansing material in separate areas so that one portion of the bar will be used for certain purposes, and other portions for other purposes.

In particular, it is an object of this invention to provide a single cleansing bar having two discrete layers.

In accordance with these and other objects, which will become apparent hereafter, the instant invention will now be described with reference to the accompanying drawings.

SUMMARY OF THE INVENTION

Figures 1, 2, 3, 4, 5, 6, 7, 8:
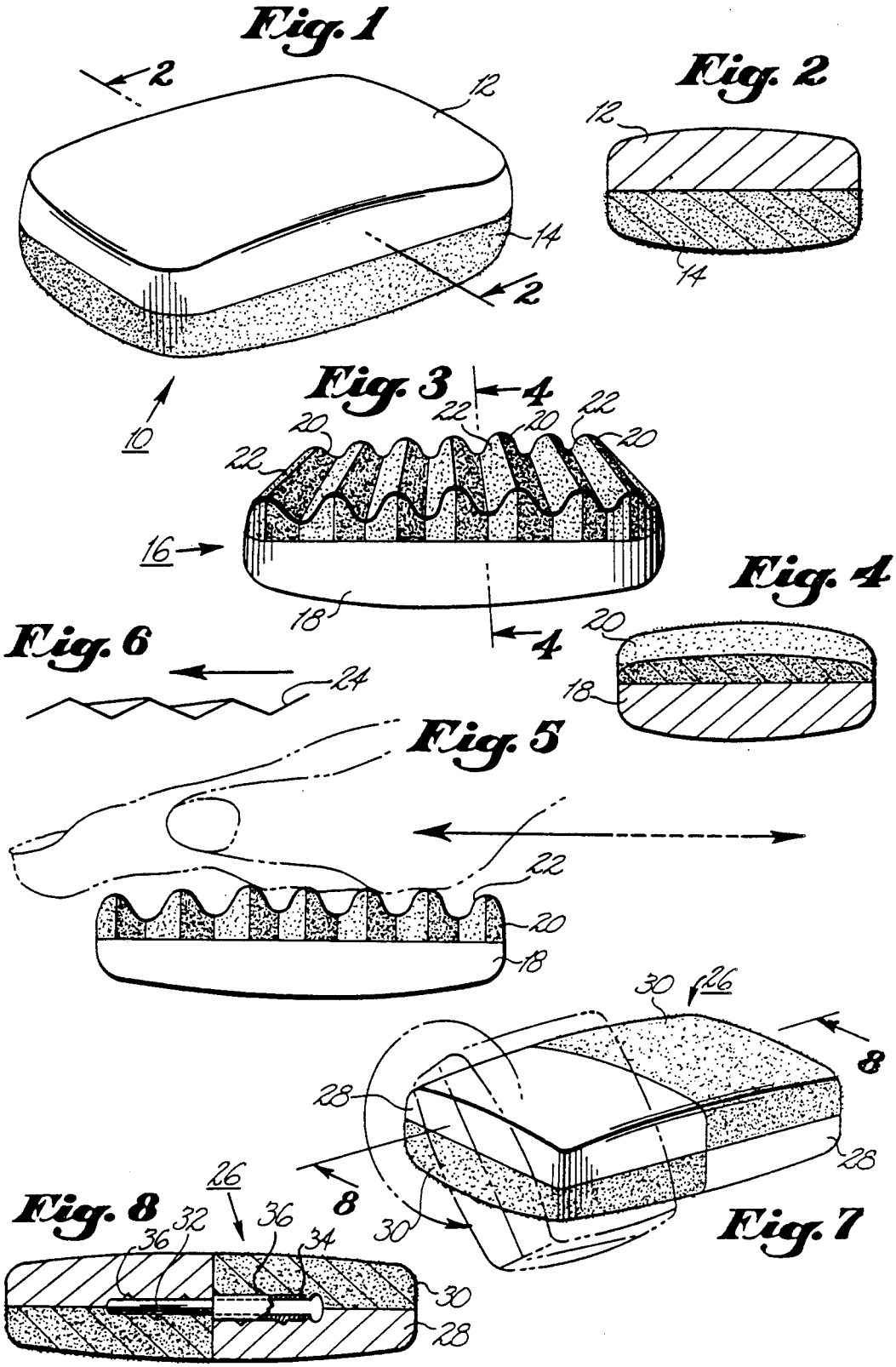
FIG. 1 is an isometric view of a cleansing bar in accordance with the invention.
FIG. 2 is a cross-section taken on the line 2—2 of FIG. 1.
FIG. 3 is a perspective of another cleansing bar having an undulating surface in accordance with the invention.
FIG. 4 is a cross-section taken on the line 4—4 of FIG. 3.
FIG. 5 shows one manner in which the cleansing bar of FIG. 3 may be used.
FIG. 6 is a detail of an alternate undulating surface.
FIG. 7 is an isometric view of another cleansing bar having two rotatable halves in accordance with the invention.
FIG. 8 is a cross-section taken on the 8—8 of FIG. 7 with a phantom showing of one half being rotated relative to the other.

A cleansing bar is formed with two layers, each of a different cleansing material. In one embodiment one layer may be a soap, and the other layer may be scouring material. The scouring material may have an undulating surface with the undulating layer having two different compositions. In another embodiment one layer may be a facial soap and the other a deodorant body soap. The bar may be divided into two longitudinally separated halves mounted on a pivot for relative rotation.

DETAILED DESCRIPTION OF THE INVENTION

Referring to FIGS. 1 and 2, bar 10 has a first layer 12 of a first solid cleansing material and a second layer 14 of a second different solid cleansing material. Layer 12 may, for example, be a soap or detergent, and layer 14 may be a soap incorporating a scouring material such as diatomaceous earth, clay, finely powdered silica or volcanic ash. The scouring layer is useful in removing ground in dirt and grease, with the soap layer being used subsequently to effect the final cleaning.

Alternately, layer 14 may be pumice and layer 12 may be a soap or detergent.

Another combination may be to have layer 12 be a facial soap without deodorant and layer 14 to be a soap including a deodorant. The purpose being to include two cleansing materials arranged so that each may be separately applied to skin areas as needed or desired.

Turning now to FIGS. 3–5, bar 16 has a first layer 18 of a first solid cleansing material. Joined to layer 18 is an undulating layer with each of the undulations having two halves 20 and 22. Halves 20 and 22 may be both scouring soaps, but each half may have a different percentage of the abrasive material or different abrasive materials. As shown in FIG. 5, movement of the bar in one direction relative to the hand tends to cause rubbing contact with one half of the undulating surface, while movement in the other direction tends to cause contact with the other half. Thus one may require the use initially of the more abrasive half of the undulations, then the less abrasive half and finally the soap or detergent of first layer 18.

FIG. 6 shows undulations 24 of intersecting planes rather than the curved undulations of the bar of FIG. 3. It will be appreciated that the angular undulations 24 will tend to become rounded as the bar is used.

FIGS. 7 and 8 show cleansing bar 26 which is divided in half longitudinally. As indicated in the phantom view of FIG. 7, the bar takes on the configuration shown when one half is rotated relative to the other half. Before rotation the bar has two layers 28 and 30 with each of the two layers being composed of a different cleansing material. The rotation is possible because pivot 32 is molded into bar 26 so as to be on the longitudinal axis of the bar. Pivot 32 has a collar 34 located in one half of bar 26. Both pivot 32 and collar 34 have small spikes 36 extending from their peripheries to permit relative rotation of the two halves. This structure requires cutting of the bar after molding, or including a removable separator for the two halves during molding.

It should be understood that the molding of cleansing bars is an old art. It is known, for example, that mixing of the two cleansing materials may occur if both are simultaneously introduced as liquids into a mold. On the other hand, if one layer of the bar is first molded, this mixing will not occur when the second liquid is introduced.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A two layered cleansing bar comprising:

a first layer of a first solid, substantially nonabrasive, cleansing material;

a second layer of different solid cleansing material inseparably joined to said first layer along a substantially centrally located plane;

said second layer having undulations with each undulation having two halves and each half of each said undulation having different abrasiveness.

2. A two layered cleansing bar in accordance with claim 1 wherein: said second layer has curved undulations.

3. A two layered cleansing bar in accordance with claim 1 wherein: said second layer has angular undulations.

4. A cleansing bar in accordance with claim 1 wherein:

said first and second layers have a common interface;

a longitudinal axis is located on said interface;

a pivot is positioned on said axis;

said pivot has two relatively rotatable parts;

said bar is divided laterally to have a first half on one of said pivot parts, and a second half on the other of said pivot parts, whereby said halves can be rotated relative to each other.

* * * * *